United States Patent [19]

Matsunami et al.

[11] Patent Number: 4,944,859

[45] Date of Patent: Jul. 31, 1990

[54] ELECTROLYTIC CELL FOR RECOVERY OF METAL

[75] Inventors: Hiroshi Matsunami; Kunio Maehara; Susumu Kosemura, all of Kanagawa, Japan

[73] Assignee: Toho Titanium Co., Ltd., Tokyo, Japan

[21] Appl. No.: 330,143

[22] Filed: Mar. 29, 1989

[30] Foreign Application Priority Data

| | | | |
|---|---|---|---|
| Mar. 30, 1988 | [JP] | Japan | 63-74597 |
| Mar. 30, 1988 | [JP] | Japan | 63-74598 |
| Jun. 8, 1988 | [JP] | Japan | 63-139440 |

[51] Int. Cl.[5] ..... C25C 3/04; C25C 3/08; C25C 3/22; C25C 7/00

[52] U.S. Cl. ..... 204/244; 204/247; 204/268; 204/245

[58] Field of Search ..... 204/243 R, 247, 68, 204/237

[56] References Cited

U.S. PATENT DOCUMENTS

| | | | |
|---|---|---|---|
| 4,076,602 | 2/1978 | Wheeler | 204/245 X |
| 4,481,085 | 11/1984 | Ishizuka | 204/245 X |

FOREIGN PATENT DOCUMENTS

| | | | |
|---|---|---|---|
| 0605864 | 5/1978 | U.S.S.R. | 204/244 |

*Primary Examiner*—Donald R. Valentine
*Attorney, Agent, or Firm*—Koda & Androlia

[57] ABSTRACT

An electrolytic cell recovery of metal comprising a first partition wall provided with partition openings situated beneath the level of an electrobath and disposed between a dissociated metal recovery chamber and an electrolytic chamber having an anode and a cathode and a second partition wall adapted to constitute an intermediate chamber between the first and second partition walls for recovery of dissociated $Cl_2$ gas; and also the arrangement of bipolar electrodes in the electrolytic cell and the shape of a control plate for preventing the deposition of sludge.

10 Claims, 8 Drawing Sheets

ELECTROLYTIC CELL FOR RECOVERY OF METAL

FIELD OF THE INVENTION

The present invention relates to an electolytic cell for electrolyzing a salt bath of metallic halide so as to effectively separate a metal substance from a halogen gas. The cell is advantageously used for an electrolysis of $MgCl_2$.

PRIOR ART

There has been provided an electrolytic cell for recovering Mg and $Cl_2$ substances by electrolyzing $MgCl_2$. Particularly, well known is a gas-lift type electrolytic cell arranged to separate and recover the Mg substance and the $Cl_2$ gas by generating a circulation of the salt electrobath bath utilizing a lifting force of the $Cl_2$ gas dissociated at the anode in electrolysis action (for example, as shown in the Japanese Unexamined Patent Publication No. 45-31529). The gas-lift type electrolytic cell is provided With a partition 7 which is arranged in a curtain-like form or has window-like openings 15 for separating the Mg metal recovery chamber 9 from the $Cl_2$ recovery chamber 5, as best shown in FIG. 2 of the Publication (and in FIG. 4 of this application). Such an arrangement allows the $Cl_2$ gas produced at the anode to circulate an electrobath with difficulty. If the speed of the electrobath increases upto about 0.3 m/sec along the electrobath level in the $Cl_2$ gas recovery chamber 5 towards the partition 7, the separation of $Cl_2$ from the electrobath is hardly effected within the $Cl_2$ recovery chamber 5. Thus, a portion of the $Cl_2$ gas in unseparated state flows in a circulation and passes the single partition 7 to enter the Mg metal recovery chamber 9. The amount of an escaped gas may be about 15% of the $Cl_2$ gas using a single electrode type.

Although there has newly been developed a bipolar electrode type electrolytic cell having more than one bipolar electrode between the anode and the cathode for the purpose of reduction in electrical source or improvement in the facility productivity. However, a means for separating and recovering Mg and $Cl_2$ remains still unchanged in substantial function from those of a single cell arrangement.

The bipolar type electrolytic cell has a narrow distance between the electrodes, whereby the lifting effect of $Cl_2$ gas on the electrobath increases and the circulating speed of the electrobath becomes higher. As a result, the $Cl_2$ gas overflowing to the metal recovery chamber due to the circulation of electrobath will be increased in volume, thus causing environmental pollution or cost increase due to a decline in the $Cl_2$ gas recovery rate.

To solve the above problem, there is proposed such an arrangement as designated by the arrow in FIG. 3 of Japanese Unexamined patent Publication No. 59-6389, having a barrage on the partition 7 so that an electrobath containing Mg and $Cl_2$ gas can pass in a thin stream for promoting the separation of $Cl_2$ gas. However, this arrangement also requires the continuous supply of a predetermined amount of $MgCl_2$ or the use of an electrobath level control device for keeping the level of the electrobath, which varys as the $MgCl_2$ is consumed, at a particular elevation in order to permit the electrobath containing Mg and $Cl_2$ to pass the barrage in a thin stream.

Accordingly, the disadvantages of the prior art electrolytic cell are as follows:

(i) The single partition allows a $Cl_2$ gas to overflow into the metal recovery chamber in a great amount, which affects the environment in a negative manner and reduces the rate of $Cl_2$ recovery as resulting in cost-up:

(ii) The electrobath level, particularly in such a bipolar type electrolytic cell as shown in the Publication 59-6389, needs to be uniform and thus, the control of electrolysis becomes troublesome;

(iii) The single partition of a similar bipolar type electrolytic cell causes a short-current, which flows via ionized Mg substances floating in the metal recovery chamber, to become high and the cell efficiency declines;

(iv) The single partition affects the flow of the electrolytic cell in a considerable scale and thus ionized Mg substances are activated in movement in the metal recovery chamber, which causes a newly developed Mg deposit to be exposed and burn for creating MgO.

(v) For the purpose of continuous supply of a specified amount of $MgCl_2$ to keep the electrobath level uniform, there will disadvantageously be required various cooperative such as measurement of the electrobath level, operation of a related supply mechanism, composition adjustment of electrobath, or the like.

SUMMARY OF THE INVENTION

It is an object of the present invention to provide an electrolytic cell capable of effectively separating the $Cl_2$ gas from the Mg metal so as to overcome the above disadvantages.

A primary arrangement according to the present invention comprises a first partition wall interposed between the electrolysis chamber and the liberated metal recovery chamber and a second partition wall arranged to constitute an intermediate chamber for recovery of gas with the cooperation of the first partition wall.

A preferred embodiment of the present invention in the form of bipolar type electrolytic cell employs, in addition to such an arrangement as described, both an electrode arrangement (referred to as a first developed arrangement hereinafter) for minimizing the current short-circuit generated mostly under the bipolar electrodes and a control arrangement (referred to as a second developed arrangement hereinafter) for reducing a deposit of sludge carried by the circulating flow of electrobath.

Embodiments of the present invention will be described in more detail with reference to the drawings.

BRIEF DESCRIPTION OF THE DRAWINGS

Figs. 5 to 11 are explanatory views showing the first developed arrangement of the present invention in relation to the prior art, in which:

FIGS. 5*a*, 5*b*, and 5*c* are schematic cross sectional views showing a primary construction of the first developed arrangement;

FIGS. 6, 7a, 7b, 7c, and 7d are schematic cross sectional views showing another construction of the first developed arrangement;

FIG. 8 is a curve diagram of voltage and current with respect to the electrolytic cell in action;

FIGS. 9 and 10 are views showing the lower structure of bipolar electrodes in a prior art electrolytic cell; and FIG. 11 is an explanatory view for calculation of the cell efficiency of the electrolytic cell.

FIGS. 12 to 15 are explanatory views showing the second developed arrangement of the present invention in relation to the prior art, in which:

FIG. 12 is a cross sectional view taken (along the line B—B of FIG. 13) in parallel to the electrode of the second developed arrangement in the electrolytic cell;

FIG. 13 is a cross, sectional view taken along the line A—A of FIG. 1;

FIG. 14 is an explanatory view showing a circulating flow of electrobath; and

FIG. 15 is an explanatory view showing a deposit of sludge on the shelf of prior art electrolytic cell.

DETAILED DESCRIPTION OF THE INVENTION

The primary arrangement of an electrolytic cell according to the present invention is characterized by a first partition wall having a plurality of partition openings formed therein beneath the level of electrobath and a second partition wall disposed to constitute an intermediate chamber situated between the first and second chambers for recovery of $Cl_2$ gas.

The primary arrangement will be described in more detail with reference to the drawings.

Figure 1:
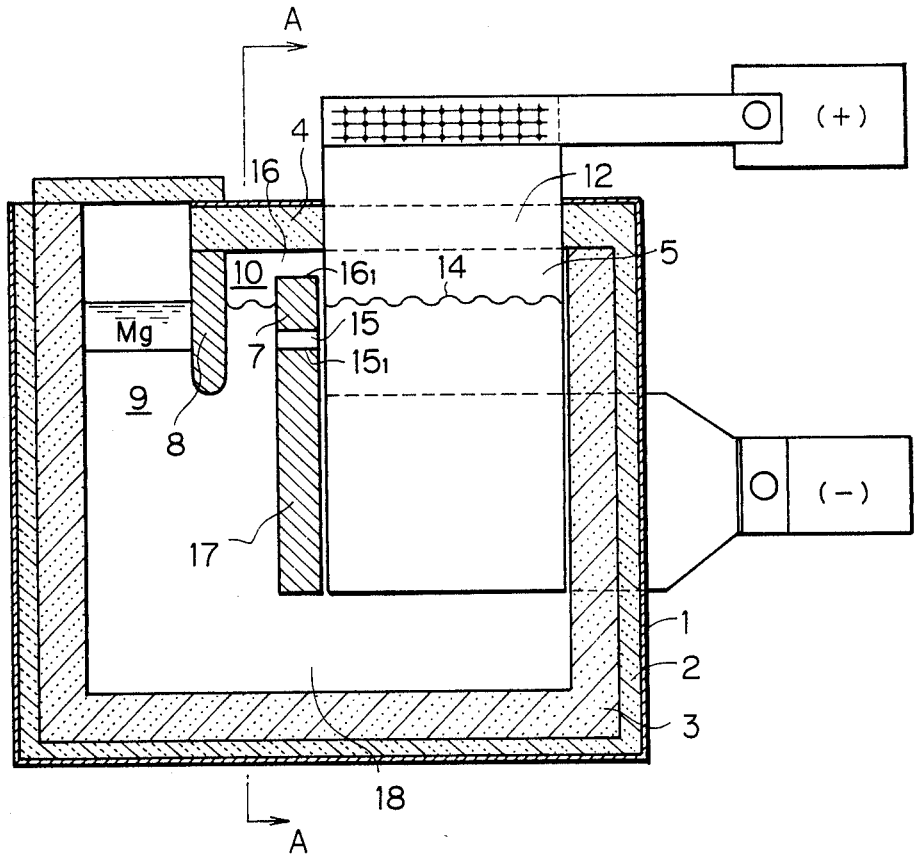
FIG. 1 is a longitudinally cross sectional view of an embodiment of the present invention showing the primary arrangment of an electrolytic cell.
Figure 2:
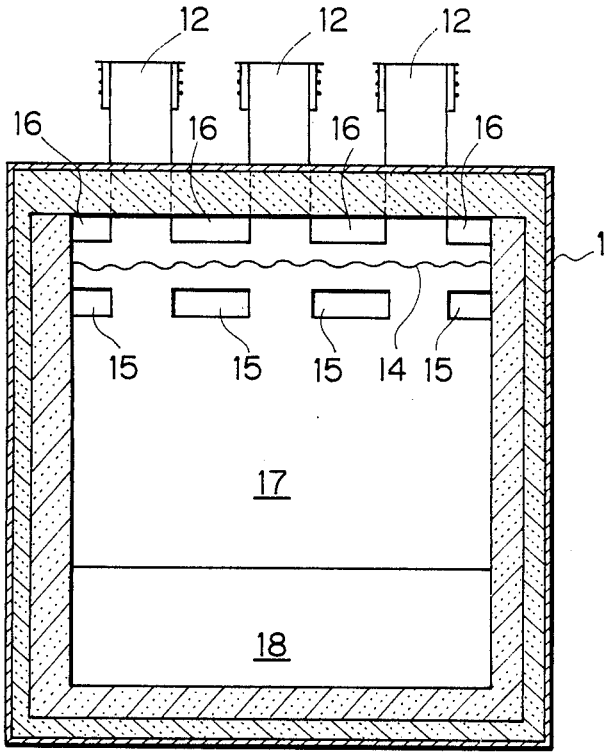
FIG. 2 is a cross sectional view taken along the line A—A of FIG .1.

As shown in FIGS. 1 and 2, there are provided a steel exterior plate 1, a thermally insulated brick wall 2, and a refractory brick wall 3. The numeral 4 is a cast cover covering the $Cl_2$ gas recovery chamber 5. The cover 4 is provided with the $Cl_2$ gas discharge conduit. The intermediate chamber 10 is interposed between the first partition wall 7 on the $Cl_2$ gas recovery chamber 5 side and the second partition wall 8 located on the side of a metal recovery chamber 9. Represented by 11 is a steel cathode inserted from the outside while 12 is a graphite anode. There may be disposed bipolar electrodes between the cathode 11 and the anode 12. The level of electrobath is represented by 14. There are also designated a partition opening 15 interposed between the first partition wall 7 and its lower entension 17, a vent 16 formed in the first partition wall 7, and a through opening 16 provided beneath the first partition extension 17 while 19 is another partition wall and 191 is a barrage.

The operation of the electrolytic cell having the primary arrangement according to the present invention will be described.

The electrolytic cell is filled with electrobath containing 20% $MgCl_2$, 30% $CaCl_2$, 49% NaCl, and 1$MgF_2$ in weight upto the liquid level 14 and then, operated by passing a direct current from the anode 12 to the cathode 11. As a result, there are produced the $Cl_2$ gas at the anode and the Mg deposit at the cathod. As the $Cl_2$ gas dissociated is much lighter in weight than the electrobath, it moves upward between the electrodes in the electrobath This causes an upward flow of the electrobath for circulation. Thus, the Mg deposit on the cathode is also moved upward by the circulating flow of electrobath and enters the $Cl_2$ gas recovery chamber 5 along with the $C1_2$ gas. When the electrolyte reaches the electrobath level 14 in the $Cl_2$ gas recovery chamber 5, most of the $Cl_2$ gas will escape from the electrobath while the electrobath continues to circulate towards the the first partition wall 7. The electrobath on reaching the first partition wall 7 flows through the partition openings 15 provided in the first partition wall 7 into the intermediate chamber 10 where the remaining of the $Cl_2$ gas is completely separated from the electrobath. The $Cl_2$ gas recovered in the intermediate chamber 10 passes the vents 16 formed in the upper of the first partition wall 7 and enter the $Cl_2$ gas recovery chamber 5 before being discharged from the discharge conduit. After release of the $Cl_2$ gas in the intermediate chamber 10, the electrobath passes beneath the second partition 8 to the metal recovery chamber 9. Then, the circulating speed of the electrobath slows down and Mg substances contained the electrobath will be liberated due to the specific gravity difference (1.75 for electrobath to 1.55 for Mg metal) and form a layer of Mg deposit in the upper of the metal recovery chamber 9.

After release of the Mg substances, the electrobath flows downward in the metal recovery chamber 9 and passes through the opening 18 formed beneath the first partition extension 17 for returning to between the anode 12 and the cathode 11. The electrobath continues a circulation.

The first partition extension 17 is arranged to restrict the flow of electrobath between the electrolytic chamber and the intermediate chamber and allow a circulating flow of electrobath from the partition openings to the lower through opening. Accordingly, the extension 17 will give the equal effect even if the electrobath is separated by an array of cathodes. The $Cl_2$ gas recovered in the upper of the intermediate chamber may be collected through separate discharge conduits while the first partition wall 7 is provided with no vent in the uppermost of the cell. This arrangement will give increased strength for mounting of the first partition wall 7.

(Example 1)

The electrobath containing 20% $MgCl_2$, 30% $CaCl_2$, 49% NaCl, and 1% $MgF_2$ was dissociated by an electric current of 100,00A in the eIectrolytic cell of FIG. 1 kept the temperature at 660° C. to 680° C. Consequently, the electrobath flowed at a great speed from the back to the front of the electrodes in the electrolytic cell and particularly, passed the first partition openings 16 in fast and strong streams while there was no escaping flow of $Cl_2$ gas into the metal recovery chamber 9. This condition remained unchanged during the time when the electrobath level 14 shifted from the lower end $16_1$ of the vent 16 to the lower end $15_1$ of the partition opening 15.

With the use of the primary arrangement of the present invention as above described, the following results are obtained. An escaping flow of $Cl_2$ gas to the metal recovery chamber g is prevented and thus, environmental pollution and a decline in the recovery rate due to rebonding of $Cl_2$ with Mg, can be avoidable. Additionally, the electrolysis operation is extensively effected during the time when the electrobath level 14 shifts from the lower end $16_1$ of the vent 16 to the lower end $15_1$ of the first partition opening 15. This eliminates the difficulty of electrobath level control which cannot be overcome in the prior art. The advantageous effects are given with equal success with the use of a bipolar type electrolytic cell having a plurality of bipolar electrodes between the anode and the cathode.

Although this example requires non of electrobath level control and continuous supply of electrobath which are problems to be solved in the prior art, it may be possible to join the present invention with the prior art in practice. Then, the necessity of electrobath level control and continuous supply of electrobath is lessened and the electrolysis operation can assuredly be carried out.

Figure 11:
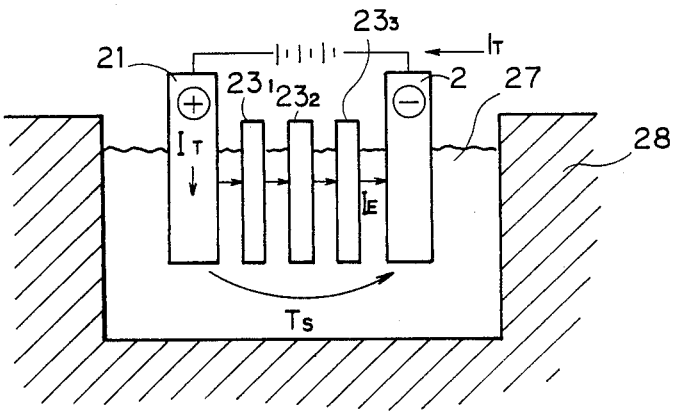

The first developed arrangement of the present invention comprises such an electrode arrangement as a short-circuit current generated mostly under the bipolar electrodes is reduced with the use of a bipolar type electrolytic cell. More specifically, there are produced short-circuit current flows between the anode and the cathod inserted from the outside into the electrolytic cell, which run without passing the bipolar electrodes and will cause a decline in the cell efficiency of the bipolar type electrolytic cell. Assuming that an electrolytic cell 28 a plurality of bipolar electrodes $\mathbf{23}_1$, $\mathbf{23}_2$, . . . and $\mathbf{23}_n$ which are disposed between an anode 21 and a cathode 22 to separate into n sections, as shown in FIG. 11, where the current applied between the anode and the cathode is $I_T$; the short-circuit current between the same $I_S$; and the current passing bipolar electrodes $I_E$, the cell efficiency is determined by:

$$n = \frac{n\,I_E + I_s}{n\,I_T} \times 100\%$$

To reduce the short-circuit current, a particular arrangement for cavity spaces around the electrodes or an Improved lower construction of the bipolar electrodes in an electrolytic cell is needed.

Figure 3:
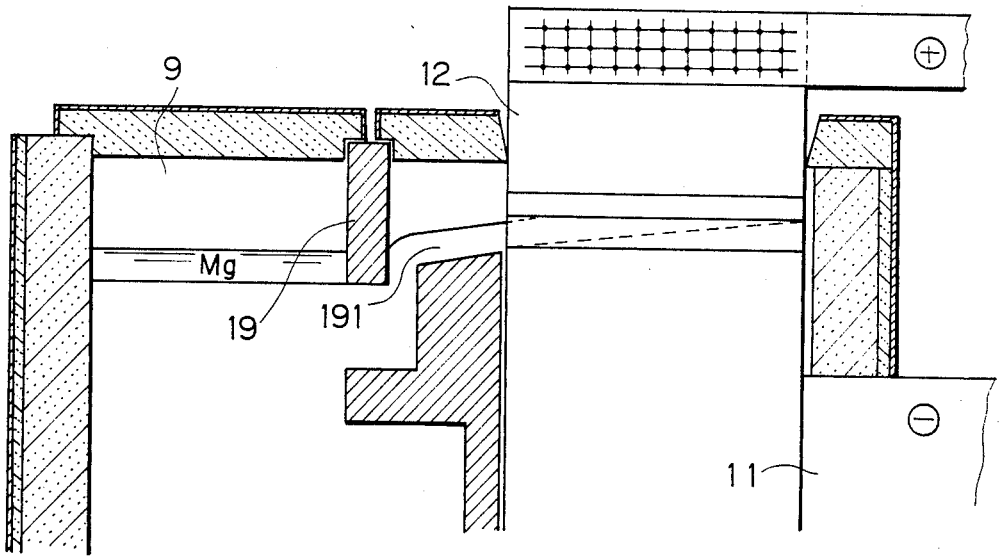
FIG. 3 (Prior Art)
FIGS. 3 and 4 are views of prior art electrolytic cells.
Figure 9:
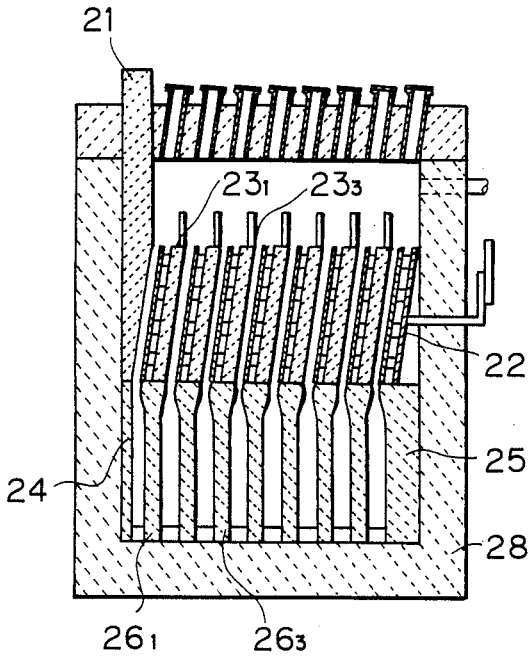
FIG. 9 (Prior Art)
Figure 10:
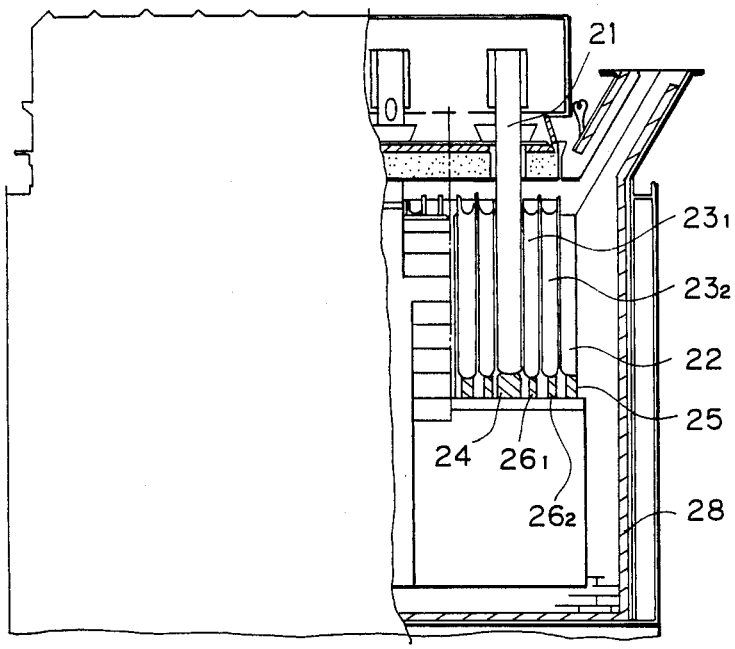
FIG. 10 (Prior Art)

Such a lower arrangement of the bipolar electrodes in a prior art electrolytic cell includes an array of electric insulation blocks disposed beneath the anode and the cathode inserted from the outside and the bipolar electrodes for control of the short-circuit current, as shown in FIG. 3 of Japanese Unexamined Patent Publication 59-6389 (FIG. 10 attached to this specification) or in FIG. 1 of No. 59-107090 (FIG. 9 attached to this application).

However, this lower arrangement of the bipolar electrodes for use with a prior art bipolar type electrolytic cell has the following disadvantages.

(i) The distance between the two adjoined insulation blocks is about 1 to 5 cm and it will be difficult to install the electric insulation blocks in the electrolytic cell for a proper arrangement.

(ii) Each electric insulation block beneath the bipolar electrode is thin and breakable.

(iii) The distance between the two insulation blocks of 1 to 5 cm is so narrow that electrolytic sludge in paste state which results from oxidization of $MgCl_2$ or Mg, can easily accumulate. As the result, there are caused a short-circuit between the electrodes and a slowdown in the flow of electrobath and thus, the cell efficiency and the current efficiency will be reduced.

Figure 5:
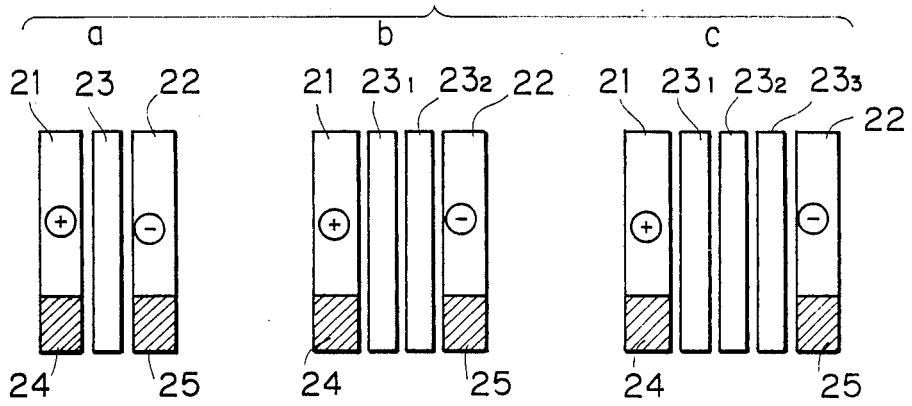
Figure 6:
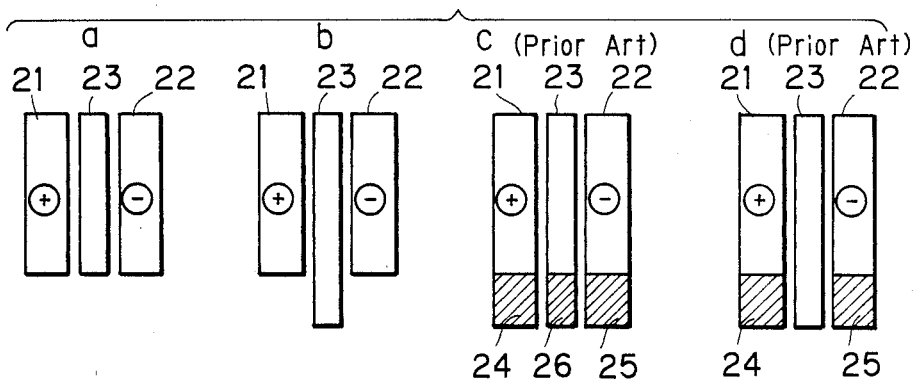
Figure 7:
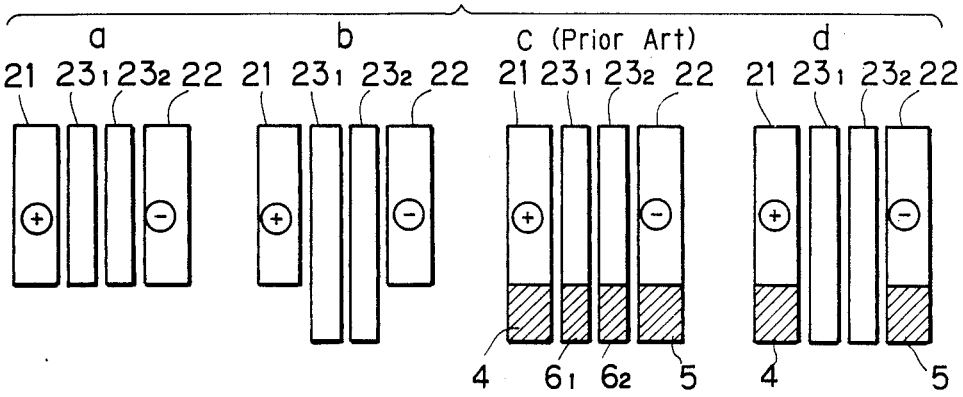

The first developed arrangement of the present invention is then adapted to overcome the above disadvantages and provide high efficiency in a bipolar type electrolytic cell, in which no electric insulation block is provided beneath the bipolar electrodes by extending downward the bipolar electrodes 23, $\mathbf{23}_1$, . . . so as to be longer than the anode 21 and the cathode 22 or extending the same to the lowermost end of the electric insulation blocks 24 and 25 which are joined to the bottom ends of the anode 21 and the cathode 22 respectively, as shown in FIGS. 5*a* to 5*c*. More specifically, the electrolytic cell having the first developed arrangement is characterized by bipolar electrodes which are extended downward instead of having at low end the electric insulation blocks 26, $\mathbf{26}_1$, . . employed for control of the short-circuit current in the prior art. The extension of the bipolar electrode may be determined to a proper length, e.g. preferably 5 to 40 times the distance between the two electrodes. Although the electrolytic cell according to the present invention provides remarkably high effectiveness with the use of not more than two bipolar electrodes, it will work with equal success with more than two bipolar electrodes. However, in the latter case, a short-circuit current flows between the bipolar electrodes and a decline in the cell efficiency will be inevitable.

During the operation of the bipolar type electrolytic cell having the first developed arrangement, advantageous effects are given by the following two functions.

I. As the distance between the electric insulation block situated beneath the anode or cathode and the lower extention of the bipolar electrode acts as a narrow and long electrical passage in the electrobath, an electrical resistance in the distance becomes great. Thus, the current causing a short-circuit between the anode and the cathode (or between the bipolar electrode and the anode or cathode) will considerably be reduced.

II. In the narrow spaces between the electric insulation blocks 26, $\mathbf{26}_1$, . . . provided in the prior art bipolar type electrolytic cell shown in FIG. 6*c*, 7*c*, 9, or 10, deposition of electrolytic sludge occurs due to no electrochemical action on the surfaces of the insulation blocks. On the other hand, the first developed arrangement has the bipolar electrodes extending downwardly of the anode and the cathode so that eIectrochemical action can occur on the surfaces of the electrodes. Accordingly, the electrode surfaces are cleaned and the flow of electrobath is activated by production of Mg and $Cl_2$, Which will minimize the deposition of electrolytic sludge.

(Example 2)

Assuming that each of the electrode arrangements schematically shown in FIGS. 6*a*, 6*b*, 6*c*, 6*d*, 7*a*, 7*b*, 7*c*, and 7*d* was used in the electrolytic cell the cell efficiency was calculated separately. The cell efficiency was about 95 % for the arrangement of FIG. 6*a* or 7*a* in which the bipolar electrode is equal in length to the anode and the cathode while no electric insulation block was employed. The cell efficiency was about 98 % for the arrangement of FIG. 6*b* or 7*b* in which the bipolar electrode was downwardly extended. Both show improvement in the efficiency. The cell efficiency was about 99.5 % for the arrangement of FIGS. 6*c* or 7*c* similar to that in a prior art electrolytic cell, which is very satisfactory. The cell efficiency was about 99.3 to 99.4 % for the improved arrangement of FIG. 6*d* or 7*d*, which almost equaled that of the prior art electrolytic cell.

Figure 8:
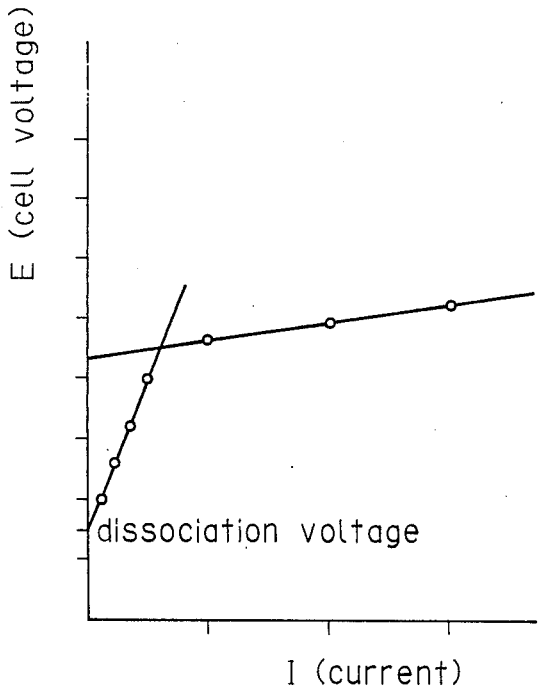

A bipolar type electrolytic cell of 100,000A capacity in which the bipolar electrode was downwardly extended 20 times the distance between the two bipolar electrodes as shown in FIG. 5*c*, was filled with an electrobath containing 20% $MgCl_2$, 30% $CaCl_2$, 49% NaCl, and 1% $Mg_2$ and operated at a temperature ranging from 660° to 68O° C. for 12 months. A change in the cell efficiency is obtained from the curve diagram of current and voltage in FIG. 8 given by measuring changes in voltage with the current reduced periodically during the operation. The cell efficiency of the bipolar type electrolytic cell was given through measuring the relation between a current I and a cell voltage E and examining the relative points and the inclination of two given lines. The resultant values were within an allowance range of each measuring device and equal to the calculated value with an equivalent circuit. Also, no time-relating change was detected. The arrangement according to the present invention was checked after the electrolytic cell stopped and no blockage with electrolytic sludge was found. It is thus determined that the electrolytic cell has been operated in a normal condition throughout the period of practice time.

Although the embodiment is described with respect to electrolysis of $MgCl_2$ solution, it is not limited to that. The bipolar electrode electrolytic cell having the improve arrangement will be utilized with equal success for electrolysis of alkaline metal, alkaline earth metal, etc under their respective conditions.

Figure 15:
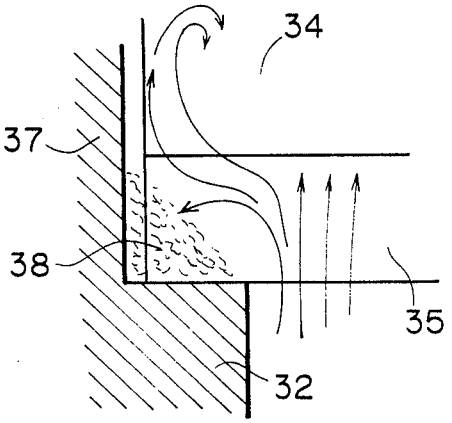
FIG. 15 (Prior Art)

The second developed arrangement according to the present invention is adapted for use with a bipolar type electrolytic cell, having such a control plate arrangement that the sludge carried by a circulating flow in an electrobath can be prevented from accumulating on a particular place in the cell. More specifically, the bipolar type electrolytic cell has insulation blocks arranged beneath the anode and cathode inserted from the outside or the bipolar electrodes for the purpose of preventing a by-pass current which flows without passing the bipolar electrodes. The insulation block is made of refractory almina material. To support the insulation blocks, there is provided a shelf formed on the inner wall of an electrolysis chamber. As a result, the flow of the electrobath moving towards the upper of the electrolysis chamber has a stagnant portion on the shelf 32 as shown in FIG. 15, and allows sludge 38 of mostly MgO to accumulate on the same. The sludge 38 also contains Mg metal substances thus having a conductive nature. Consequently, the sludge 38 short-circuits between the electrodes and electrosis between the same will be prevented. Also, above the shelf 32 there are caused turbulent flows in the electrolyte bath and the bonding reaction of Mg metal and $Cl_2$ gas dissociated by electrolysis will be increased.

To solve the above problem, there has been proposed a prior art in which the shelf is arranged to have a sloping top and incorporated with the inner wall of an electrolysis chamber so as to prevent an electrobath circulating flow from stagnating.

Accordingly, a prior art bipolar type electrolyte cell has a sloping top shelf incorporated with the inner wall of the electrolysis chamber to prevent the electrobath circulating flow from stagnating in the electrolysis chamber. The disadvantages are:

(i) It will be difficult in process and installation due to an integrated arrangement of the sloping top of the shelf to the inner wall of the electrolysis chamber;

(ii) It will be breakable due to an integrated arrangement of the sloping top of the shelf to the inner wall of the electrolysis chamber; and (iii) It will be less flexible and thus, may give damage to electrodes due to an integrated arrangement of the sloping top of the shelf to the inner wall of the electrolysis chamber.

The second developed arrangement of the present invention is then adapted to overcome the above disadvantages and provide high effectiveness in a bipolar type electrolytic cell.

Figure 12:
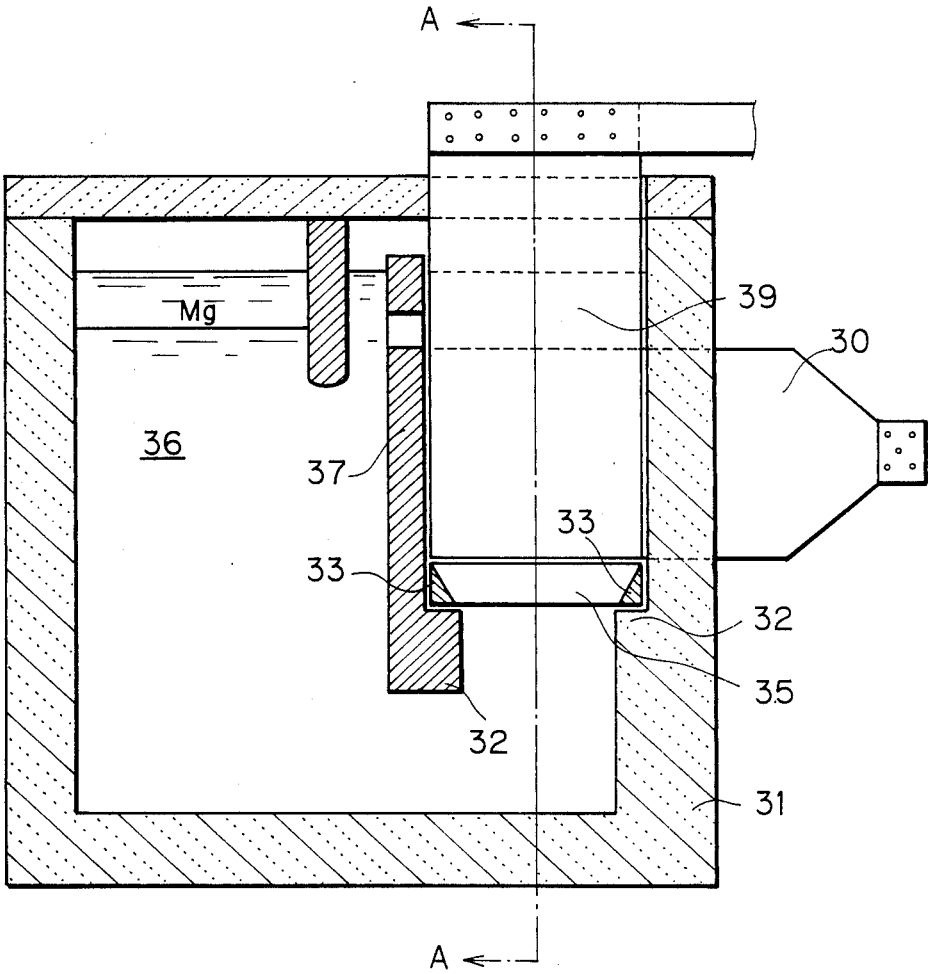
Figure 13:
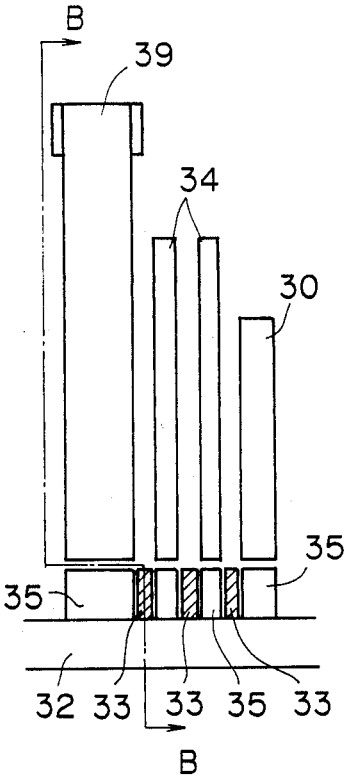
Figure 14:
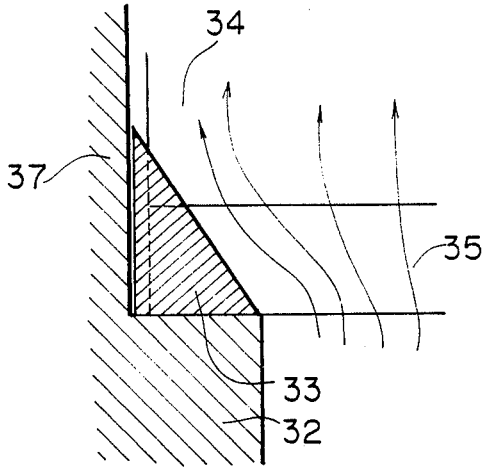

For the purpose, the bipolar type electrolytic cell having the second developed arrangement has control plates 33 disposed on the shelves 32 in the electrolysis chamber separately from the inner wall of the electrolysis chamber for slow dispersion of the circulating flow in an electrobath, as shown in FIGS. 12 and 13. Designated in FIG. 31 are a bipolar electrode 34, an insulation block 35, an electrobath 36, an electrolysis chamber inner wall 37, a sludge deposit on the shelf 38, a cathode 30, and an anode 39. The arrows in FIGS. 14 and 15 represent flows in the electrobath.

Figure 4:
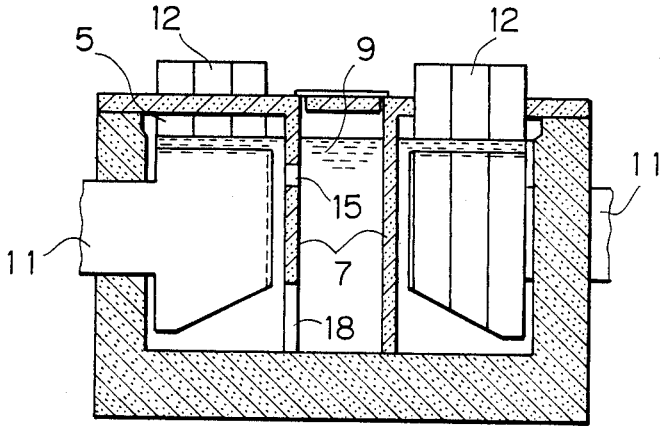
FIG. 4 (Prior Art)

The control plate 38 used in the embodiment is so shaped as to disperse the circulating flow in the electrobath generally as shown in FIG. 4 and prevent the deposition of sludge 38 shown in FIG. 15 in which no control plate is employed. Preferably, the control plate 38 is of a right-angled triangle having the bottom equal in length to the shelf and arranged at an angle of 30° to 80° to the sloping side. The sloping side may moderately be curved in either convex or concave form other than straight configuration.

During the operation of the bipolar type electrolytic cell having the second developed arrangement, advantageous effects are given by the following functions. The control plates provided on the shelf of the electrolysis chamber separately from the inner wall of the electrolysis chamber, which are unbreakable and will give no damage to the electrodes, prevent sludge from accumulating on the shelf during the passing of a circulating flow in the electrobath and also, allow no stagnation nor excessive turbulance in the circulating flow.

(Example 3)

A bipolar electrolytic cell having the control plates of alumina material, each of which has a bottom of 100 mm length and a sloping side arranged at an angle of 60° to the bottom, and is 10 mm in thickness, disposed between the electrodes (i.e. between the anode and a bipolar electrode, between the bipolar electrodes, and betWeen a bipolar electrode and the cathode), was filled with an electrobath containing 20% $MgCl_2$, 54% NaCl, 25% $CaCl_2$, and 1% $MgF_2$. Then, an electrolysis operation has been carried out at a bath temperature of 660° to 670° under a condition of applying an electrolytic current of 100,000A for 12 months.

The electrolytic cell had been running well during the operation and thereafter, was disassembled for inspection of the shelf 32 and controlplates 83. As a result, the predicted effects were obtained with no damage to the plates . nor the electrodes and no deposition of sludge generated.

What is claimed is:

1. An electrolytic cell for recovery of metal comprising a first partition wall provided with partition openings situated beneath the level of an electrobath and disposed between a dissociated metal recovery chamber and an electrolytic chamber having an anode and a cathode and a second partition wall adapted to constitute an intermediate chamber between said first and second partition walls for recovery of dissociated $Cl_2$ gas.

2. An electrolytic cell for recovery of metal as defined in claim 1 wherein said first partition wall is spaced from the ceiling of the cell so that said intermediate chamber can communicate with the upper of the electrolytic chamber.

3. An electrolytic cell according to claim 1 or 2 wherein said second partition extends from said ceiling of the cell to a level beneath a level of said electrobath.

4. An electrolytic cell for recovery of metal as defined in claim wherein said first partition wall is closely fitted to the ceiling of the cell so that said intermediate chamber can be separated from the upper of the electrolytic chamber.

5. An electrolytic cell for recovery of metal as defined in claim 1, 2, or 4 wherein the partition openings in the first partition wall is incorporated at lower end with the cathode in the electrolytic chamber.

6. A bipolar type electrolytic cell for recovery of metal as defined in claim 1 further comprising bipolar electrodes, the lower end of which is extended downwardly from the lower end of the anode and cathode inserted from the outside.

7. A bipolar type electrolytic cell for recovery of metal as defined in claim 6 further comprising electric insulation blocks mounted respectively to the lower ends of the anode and the cathode inserted from the outside.

8. A bipolar type electrolytic cell for recovery of metal as defined in claim 6 or 7 wherein the bipolar electrode is extended 5 to 40 times the distance between the to bipolar electrodes downwardly from the lower end of the anode and cathode inserted from the outside.

9. A bipolar type electrolytic cell for recovery of metal comprising a first partition wall provided with partition openings situated beneath the level of an electrobath and disposed between a disassociated metal recovery chamber and an electrolytic chamber having an anode and a cathode and a second partition wall adapted to constitute an intermediate chamber between said first and second partition walls for recovery of disassociated $Cl_2$ gas and wherein the insulation blocks situated beneath the anode and cathode or the bipolar electrodes are supported by shelves formed on the inner wall of the electrolytic chamber and control plates for preventing the stagnation of an electrobath flow are alternately disposed between the insulation blocks.

10. A bipolar type electrolytic cell for recovery of metal as defined in claim 9 wherein the control plate is a separated member from the inner wall of the electrolytic chamber and substantially formed of a triangle shape, more particularly a right-angled triangle shape having a bottom side arranged at 30° to 80° to a sloping side.

* * * * *